US006747684B2

(12) United States Patent
Ornellas et al.

(10) Patent No.: US 6,747,684 B2
(45) Date of Patent: Jun. 8, 2004

(54) LASER TRIGGERED INKJET FIRING

(75) Inventors: Frederic Adam Ornellas, Boise, ID (US); Michael A. Garris, Boise, ID (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 28 days.

(21) Appl. No.: 10/121,012

(22) Filed: Apr. 10, 2002

(65) Prior Publication Data

US 2003/0193557 A1 Oct. 16, 2003

(51) Int. Cl.[7] ..... B41J 2/435; B41J 2/14; B45J 2/435

(52) U.S. Cl. ..... 347/243; 347/51; 347/58

(58) Field of Search ..... 347/243, 51, 58, 347/50, 20, 26, 40, 45, 47, 48, 52, 55, 56

(56) References Cited

U.S. PATENT DOCUMENTS

| | | | | |
|---|---|---|---|---|
| 4,233,612 | A | 11/1980 | Hirayama et al. | 347/137 |
| 4,513,298 | A | 4/1985 | Scheu | 347/64 |
| 4,535,343 | A | 8/1985 | Wright et al. | 347/64 |

(List continued on next page.)

FOREIGN PATENT DOCUMENTS

| | | | |
|---|---|---|---|
| EP | 0829356 | A2 | 3/1998 |
| EP | 0861724 | A2 | 9/1998 |
| EP | 0829356 | A3 | 3/1999 |
| EP | 0861724 | A3 | 10/1999 |
| EP | 1008451 | A2 | 6/2000 |
| EP | 1008451 | A3 | 3/2001 |
| JP | 54156634 | | 10/1979 |
| JP | 02022065 | | 1/1990 |
| JP | 02225049 | | 9/1990 |
| JP | 04246542 | | 9/1992 |
| JP | 04305483 | | 10/1992 |
| JP | 05212869 | | 8/1993 |
| JP | 05261927 | | 10/1993 |
| JP | 08080609 | | 3/1996 |
| JP | 08099417 | | 4/1996 |
| JP | 11105276 | | 4/1999 |
| JP | 2001353875 | | 12/2001 |
| WO | WO97/29914 | | 8/1997 |

OTHER PUBLICATIONS

"Introduction to Solid State Physics", by Charles Kittel, Seventh Edition, 1996, John Wiley & Sons, Inc.; p. 573.

"Physics of Semiconductor Devices", by Michael Shur, 1990, Prentice–Hall, Inc.; pp. 501–508.

"Semiconductor Physics and Devices", by Donald A. Neaman, Second Edition, 1997, The McGraw–Hill Companies; pp. 280–292.

U.S. patent application entitled "Fluid Ejection and Scanning Assembly with Photosensor Activation of Ejection Elements", U.S. application Ser. No. 10/164,540, filed Jun. 7, 2002.

U.S. patent application entitled "Fluid Ejection and Scanning System with Photosensor Activation of Ejection Elements", U.S. application Ser. No. 10/164,786, filed Jun. 7, 2002.

U.S. patent application entitled "Photosensor Activation of an Ejection Element of a Fluid–Ejection Device", U.S. application Ser. No. 10/165,226, filed Jun. 7, 2002.

U.S. patent application entitled "Fluid Ejection System with Photosensor Activation of Ejection Element", U.S. application Ser. No. 10/164,808, filed Jun. 7, 2002.

*Primary Examiner*—Hai Pham

(57) ABSTRACT

A printing system has a laser scanner and a print bar such as a page-width-array printhead associated with an array of photodetectors. The scanner scans the array of photodetectors, to selectively light activate photodetectors in the array. Each photodetector, when activated by the scanner triggers its associated inkjet nozzle(s) in the printhead to deposit ink on a media surface. In one embodiment the page-width-array is stationary and the media is periodically advanced as ink drops are deposited.

24 Claims, 12 Drawing Sheets

U.S. PATENT DOCUMENTS 4,745,416 A 5/1988 Horihata ..... 347/259
4,764,776 A 8/1988 Mugrauer et al. ..... 347/232
4,769,659 A 9/1988 Umeda et al. ..... 347/238
4,783,149 A 11/1988 Umeda et al. ..... 349/42
4,794,410 A 12/1988 Taub et al. ..... 347/65
4,794,463 A 12/1988 Tamura et al. ..... 358/296
4,812,859 A 3/1989 Chan et al. ..... 347/63
4,847,630 A 7/1989 Bhaskar et al. ..... 347/63
4,862,197 A 8/1989 Stoffel ..... 347/59
4,894,664 A 1/1990 Tsung Pan ..... 347/63
4,903,051 A 2/1990 Egawa et al. ..... 347/137
5,021,808 A 6/1991 Kohyama ..... 347/66
5,040,074 A 8/1991 Stemmle ..... 358/296
5,095,376 A 3/1992 Umeda et al. ..... 349/3
5,159,349 A 10/1992 Endo et al. ..... 347/3
5,589,865 A 12/1996 Beeson ..... 347/28
5,619,234 A * 4/1997 Nagato et al. ..... 347/55
5,691,759 A 11/1997 Hanson ..... 347/233
5,719,602 A 2/1998 Hackleman et al. ..... 347/14
5,732,168 A 3/1998 Donald ..... 385/16
5,734,394 A 3/1998 Hackleman ..... 347/42
5,742,305 A 4/1998 Hackleman ..... 347/42
5,745,152 A 4/1998 Vincent et al. ..... 347/238
5,760,817 A 6/1998 Foote ..... 347/248
5,805,296 A 9/1998 Hattori ..... 358/300
5,844,588 A 12/1998 Anderson ..... 347/135
5,861,899 A * 1/1999 Nguyen et al. ..... 347/40
5,870,132 A 2/1999 Inoue et al. ..... 347/243
5,920,336 A 7/1999 Lawton et al. ..... 347/255
5,929,892 A 7/1999 Towner et al. ..... 347/255
5,933,184 A 8/1999 Ishigami et al. ..... 347/249
5,984,464 A 11/1999 Steinfield et al. ..... 347/87
5,991,055 A 11/1999 Haselby et al. ..... 358/509
6,135,586 A 10/2000 McClelland et al. ..... 347/42
6,139,126 A * 10/2000 Ayata et al. ..... 347/13
6,266,073 B1 7/2001 Yergenson ..... 347/115
6,318,825 B1 11/2001 Carau, Sr. ..... 347/2
6,520,628 B2 2/2003 McClelland et al. ..... 347/65

* cited by examiner

LASER TRIGGERED INKJET FIRING

RELATED APPLICATIONS (Not applicable)

STATEMENT REGARDING FEDERALLY SPONSORED RESEARCH OR DEVELOPMENT (Not applicable)

FIELD OF THE INVENTION

This invention relates to inkjet printing technology, and laser-scanning technology where a laser is used to transfer image data.

BACKGROUND OF THE INVENTION

Currently, two commonly used technologies for imaging are laser (also referred to herein as "electrophotographic") systems, and ink jet systems. In both of these systems, digital image data, produced by a computer, or the like, is transferred to the printer, which renders this data as a visible image upon a media. In most computer and printer systems, the image data for the printer is digital data which is stored in computer memory. This is the case for inkjet and laser printers, including both color and monochrome. The data is stored in a matrix or "raster" which identifies the location and color of each pixel which comprises the overall image. The raster image data can be obtained by scanning an original analog document and digitizing the image into raster data, or by reading an already digitized image file. The former method is more common to photocopiers, while the latter method is more common to printing computer files using a printer. Accordingly, the technology to which the invention described below is applicable to either photocopiers or printers. Recent technology has removed this distinction, such that a single printing apparatus can be used either as a copier or as a printer for computer files. These apparatus have been known as multifunction printers ("MFPs)", a term indicating the ability to act as a photocopier, a printer, or a facsimile machine. Accordingly, the expression "printer" should not be considered as limiting to a device for printing a file from a computer, but should also include a photocopier capable of printing a digitized image of an original document. "Original documents" include not only already digitized documents such as text and image files, but photographs and other images, including hybrid text-image documents, which are scanned and digitized into raster data.

In any event, the image to be printed onto tangible media is stored as a digital image file. The digital image data is then used to drive a printing element to create an image. The raster image data file is essentially organized into a two dimensional matrix, that is translated by the printer into an image on the media. The image comprises a number of lines with each line comprising a number of discrete dots or pixels across the line. Each pixel in the image is assigned a binary value in the data file relating information pertaining to its color and potentially other attributes, such as density. The combination of lines and pixels makes up the resultant image.

As described the raster data is stored in computer readable memory as a raster image. That is, the image is cataloged by line, and each line is cataloged by each pixel in the line. A computer processor reads the raster image data line by line, and actuates the printer. For laser printers, this involves actuation of a laser that scans a photosensitive surface to selectively expose a pixel on the surface, based on the presence or absence of coloration, and the degree of coloration for the pixel. Typical pixel densities for images are in the range of 300 to 1200 pixels per inch, in each direction. For inkjet printers, actuation of the printer involves selective actuation of an inkjet nozzle to form, based upon the presence of absence of coloration, pixels upon a media surface.

Scanning in Laser Printers

In laser printers, the method of transferring the digital raster data to a photoconductor via a laser, lasers or LEDs is known as the image scanning process or the scanning process. The scanning process is performed by a scanning portion or scanning section of the electrophotographic printer. The process of attracting toner to the photoconductor is known as the developing process. The developing process is accomplished by the developer section of the printer. Image quality is dependent on both of these processes. Image quality is thus dependent on both the scanning section of the printer, which transfers the raster data image to the photoconductor, as well as the developer section of the printer, which manages the transfer of the toner to the photoconductor.

In the scanning process, a laser is scanned from one edge of the photoconductor to the opposing edge and is selectively actuated or not actuated on a pixel-by-pixel basis to scan a line of the image onto the photoconductor. The photoconductor advances and the next line of the image is scanned by the laser onto the photoconductor. In a multiple laser printer, more than one laser can be actuated simultaneously so as to more quickly generate the complete image onto the photoconductor. The side-to-side scanning of each laser is traditionally accomplished using a dedicated multi-sided or faceted rotating mirror. Such a mirror will be known herein as a "polygon" due to the polygonal shape of the mirror. The reflective surface of the mirrors is typically ground and polished aluminum. The laser beam impinges on one facet of the polygonal mirror and is reflected to a secondary or deflector mirror, which directs the laser beam to a unique, relative lineal position on the light sensitive surface of the photoconductor. By "relative", it is understood that the photoconductor moves with respect to the linear position, but the position remains fixed in space. As the polygonal mirror rotates, the angle of incidence, and hence the angle of reflection, of the laser beam will vary. This causes the laser beam to be scanned across the photoconductor at the unique relative lineal position from a first edge to a second edge of the photoconductor. As the mirror rotates to an edge of the polygon between facets, the laser is essentially reset to the first edge of the photoconductor to begin scanning a new line onto the photoconductor. These mirrors tend to rotate at very high speeds, often in excess of 20,000 rpm.

Examples of laser scanning systems used in laser printers are disclosed in U.S. Pat. Nos. 5,691,759; 5,745,152; 5,760,817; 5,870,132; 5,920,336; 5,929,892; and 6,266,073 which are hereby incorporated by reference.

Inkjet Printheads

Most commercial inkjet printers use a moving or scanning printhead system wherein a printhead comprising ink nozzles is moved or scanned across the surface of a media. As the printhead moves over the surface, each ink nozzle is selectively activated to eject an inkjet or ink droplet to form a pixel on the media as the head passes over the surface.

To eject the droplet, ink is delivered under pressure to a printhead nozzle area. According to one method, the ink is heated causing a vapor bubble to form in a nozzle which then ejects the ink as a droplet. Droplets of repeatable velocity and volume are ejected from respective nozzles to effectively imprint characters and graphic markings onto a printout.

An inkjet printhead is formed by a substrate plus several layers defining multiple nozzle areas. The substrate and layer qualities and dimensions are selected to achieve desired thermodynamic and hydrodynamic conditions within each nozzle. Various patents teach aspects of printhead fabrication, including U.S. Pat. Nos. 4,513,298 (Scheu); 4,535,343 (Wright et al.); 4,794,410 (Taub et al.); 4,847,630 (Bhaskar et al.); 4,862,197 (Stoffel); and 4,894,664 (Tsung Pan), which are incorporated by reference.

Conventional inkjet printheads extend over a limited portion of a page-width and scan across the page. This contrasts with a page-wide-array ("PWA") printhead that extends over an entire page-width (e.g., 8.5", 11", A4 width) and is fixed relative to the media path. The PWA printhead is formed on an elongated printbar and includes thousands of nozzles. The PWA printbar is generally oriented orthogonally to the paper path. During operation, the printbar and the PWA printhead are fixed while a page is fed adjacent to and moves under the printhead. The PWA printhead prints one or more lines at a time as the page moves relative to the printhead. This compares to the printing of multiple characters at a time as achieved by scanning-type printheads.

In a PWA inkjet printhead the printhead includes a flexible printed circuit ("flex circuit") coupled to the printbar. Attached to the flex circuit are silicon substrates in which are formed nozzle chambers with firing resistors. The flex circuit with silicon substrates is adhesively attached to the printbar. The printbar includes recessed areas for receiving respective silicon substrates. Signal paths in the flex circuit carry signals to the firing resistors. An addressed firing resistor heats up ink in a corresponding nozzle chamber resulting in an ejection of an ink droplet.

The printhead of a PWA inkjet printer includes thousands of nozzles. For an 11-inch printhead printing at 600 dpi, there are at least 6600 nozzles along the printhead. Ink is delivered from a resident reservoir to a nozzle chamber of each nozzle. During operation, the printer element is fixed while a page is fed adjacent to the printhead by a media handling subsystem. When printing, a firing resistor within a nozzle chamber is activated so as to heat the ink therein and cause a vapor bubble to form. The vapor bubble then ejects the ink as a droplet. Droplets of repeatable velocity and volume are ejected from respective nozzles to effectively imprint characters and graphic markings onto a media sheet. The PWA printhead prints one or more lines at a time as the page moves relative to the printhead. Examples of PWA printer systems are disclosed in U.S. Pat. Nos. 5,589,865; 5,719,602; 5,734,394; 5,742,305; and 6,135,586 which are hereby incorporated by reference.

The PWA printhead contrasts with the moving or scanning printheads, where scanning type printheads scan across a page while the page is intermittently moved by a media handling subsystem. A PWA printer element is analogous to the moving printhead as both eject ink drops upon a media surface that has relative movement to the printhead. However, the PWA has substantially more nozzles and it is fixed in position. There is relative movement between the printhead and the media in both PWA and moving printhead systems, which accounts for some similarities in construction. However, a PWA printhead is fixed, and typically much larger that a moving printhead. A PWA printer element can include several thousand nozzles extending the length of a page-width, while that of a conventional moving printhead usually has between 100 and 300 nozzles extending a distance of approximately 0.15 to 0.50 inches.

One of the driving motivations for creating a page-wide-array printhead is to achieve faster printing speeds. In particular it is desirable that a PWA printhead run at a print speed approaching nozzle speed. Nozzle speed is the highest frequency at which a nozzle is capable of firing as limited by nozzle technology, which under current technologies approaches 1500 Hz for conventional inkjet printers, and up to 6000 to 8000 Hz for certain high resolution inkjet printers. Print speed in a PWA is directly related to the frequency at which nozzles are actually fired during a print operation. Print speed typically is less than the maximum nozzle speed due to limitations in data handling (i.e., data throughput) and media handling. With more nozzles the PWA printer element should print much faster than a smaller scanning printhead, but because of limitations, particular with data handling, the potential speed of PWA systems has not been reached. Conceivably, with faster data throughput, the printing speed could be faster than many laser printers. Given a 1000 Hz firing rate for the inkjet nozzles, which is well within the rate commonly achieved in current inkjet printers, the printing speed could be 13.8 inches second over the width of the page for a 600 dpi resolution. Basically, a PWA printhead should be able to print an entire page in approximately the same timeframe it takes a moving printhead to make one scan across a page. If the data handling for the many thousand of nozzles in a PDA can be achieved in the same time frame as the data handling for the relatively few nozzles in a conventional moving printhead, the potential speed of the PWA can be more closely realized.

A part of the data-handling problems in a PWA is to assure that pixel or dot data is available at each nozzle in a timely fashion. With thousands more nozzles than a conventional scanning printhead, the rapid data transfer to achieve such data throughput is a significant challenge. Directly connecting the raster data memory storage and processor in parallel fashion could conceivably achieve a rapid data transfer, but because of the high number of nozzles and the high number of separate conductors and connectors that this would require, such an approach is not practical. A solution to this problem is to reduce the number of conductors and use any of a number of multiplexing schemes, wherein the firing signals are processed and firing signals for several nozzles are sent serially over a common conductor. While these systems significantly reduce the number of conductors required for the data transfer and make PWA construction practical, the data processing involved and the inherently slower communication rate for serial, as compared to parallel communication, significantly slows the rate of data transfer. Thus a challenge that has not yet been met is to increase the rate of data transfer for the thousands of the nozzles within the space constraints of a print head.

BRIEF SUMMARY OF THE INVENTION

An aspect of the present invention is an imaging apparatus comprising a media transport for transporting media through a print zone, a page-wide-array inkjet printhead, and a photodetector array associated with the PWA printhead that is adapted to receive data from a laser scanner. The media transport is any suitable system known in the art for use with the PWA inkjet system, such that a PWA printhead is disposed with respect to the media to image the media as it is transported through the print zone. The PWA printhead comprises a plurality of the inkjet nozzles activated by an electrical pulse. When activated the nozzles create alphanumeric text, graphics and/or images by selectively applying ink drops to a pixel grid on the media surface as it passes under the nozzle. The photodetector array is associated with the PWA printhead and comprises a plurality of photodetectors with each photodetector of the photodetector array electrically connected to one of the nozzles. Upon light activation, the photodetector generates the electrical pulse to activate the nozzle.

The laser scanner is so disposed and constructed to direct a scanning laser at the photodetector array. By modulating the laser beam it is possible to selectively activate each photodetector to fire its associated nozzle. The laser scanner is programmed with raster data which defines the on/off pixel pattern of ink drops to be applied to the media. The use of a laser beam for transmitting the raster data eliminates the use of multiple interconnects typically formed by separate electrical conductors connecting each nozzle resistor of the printhead to the data processor. In a simple embodiment of the invention, the only electrical interconnect conductors required for the printhead are a power line and a ground line.

The advantages of the present invention can be obtained using laser-scanning technology that is well developed for electrophotographic printing systems. The PWA printhead construction uses known PWA construction, the difference being in the system for data transfer. Data is transferred to the PWA printhead by a laser scanning system similar to those used in electrophotographic systems. The laser scanner scans an array of photodetectors on the printhead. Each photodetector is associated with and electrically connected to a single firing resistor of an inkjet nozzle. Thus, an inkjet nozzle is actuated when the laser scanner is modulated to activate its associated photodetector.

There is no physical electrical connection between the printhead and the print data source for data transfer, as the data is now transferred by the scanning modulated laser beam. The data stream is much the same as a laser printer, where the data stream is used to create a raster image upon a photoelectric (i.e. photoconductive) surface. However, in the present invention, instead of creating an undeveloped electrostatic image, the scanner laser selectively activates individual photodetectors, which through activation of inkjets, results in selective creation of ink pixels on the media to form an image. As further described below, the data stream, and hence the modulations of the laser beam, may be identical to that used to modulate a laser in an electrophotographic system. However, the data stream may also be modified as desired to accommodate different designs for the PWA printhead and the photoconductor array.

Another advantage of the present invention is the mechanical simplicity. In addition to eliminating multiple conductors and connectors, the amount of moving parts is minimized. In one aspect of the invention, the only moving part for the pen or printhead is the scanning mirror for the laser scanner. Essentially, the only other moving parts are involved with the media-transfer system. In contrast laser printer systems require moving photosensitive belts or drums, and toner transfer and fixing systems, while inkjet printing requires carriage systems for the printhead with associated indexing and control systems.

The present invention can be easily adapted for either a monochrome printing system or a multicolor printing system. Color can be easily implemented using, for example, variations of multi-chamber inkjet designs known in the art.

The present invention can be seen as an optical multiplexing system where the data is transmitted to the PWA by an optical system, with the power to fire inkjet resistors carried to the PWA through electrical conductors. The only electrical connections required are for the power connection, since the data controlling the activation of the resistors is transmitted by the optical systems.

DETAILED DESCRIPTION OF THE INVENTION

Figure 1:
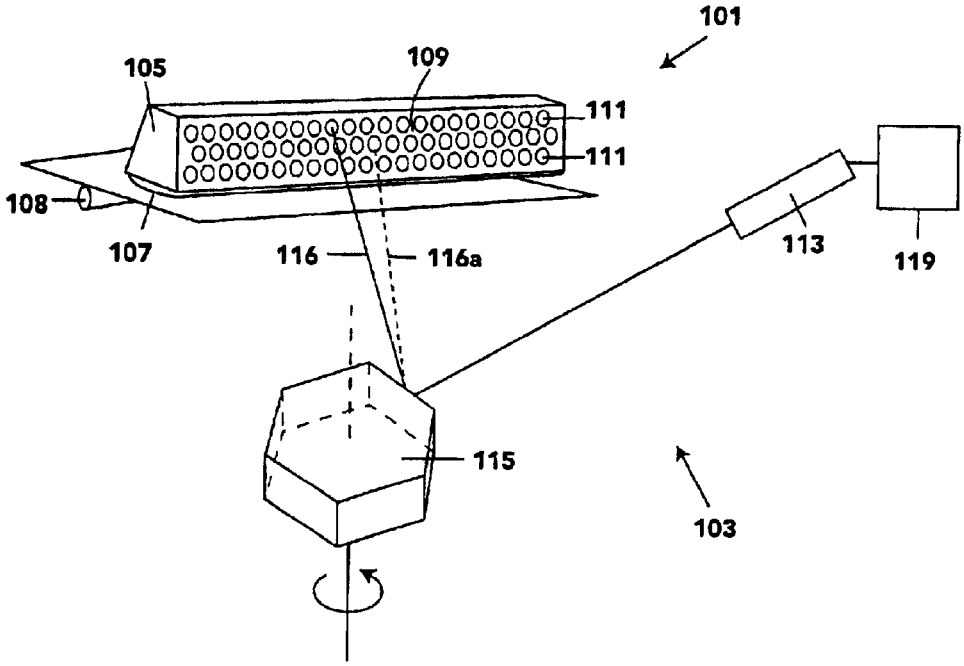
FIG. 1 is a schematic of a printing system according to an embodiment of the present invention.

Referring to FIG. 1, an aspect of the present invention is a printing system 101 that comprises a laser scanning system 103, and a printhead 105 with an optical page-width-array 107 (PWA) that includes a scannable array 109 of photodetectors 111.

Laser Scanning System

Generally, the laser scanning systems used in laser printing technology can be applied in the present invention. In laser printers the laser scans a photosensitive surface on a drum or belt. While scanning the laser is modulated to form an undeveloped electrostatic image of pixels on the surface where the laser impinges upon the surface. The photosensitive surface is moved relative to the scanning line of the laser to allow a portion of or full page of raster scan lines to be imaged upon the photosensitive surface. The undeveloped image of raster lines is then developed by contacting the surface with toner. The toner image is then transferred to a media and toner image is fixed upon the media.

In the present invention, the laser scans an array of photodetectors, where each photodetector is identified with a "pixel" on the pixel grid. As the laser is modulated, only selected combinations of photodetectors are activated by the laser. Thus, the "image" scanned upon the photodetector array represents a two dimensional pattern of "on" or "off" pixels respectively associated with activated and non-activated photodetectors. As more fully described herein, a photodetector when activated triggers its associated inkjet nozzle, which then ejects an ink droplet on a media surface. The photodetector array does not move relative to the scanning line or path of the laser. Instead, the media is preferably moved relative to the inkjet nozzles. Thus, in a printing operation according to a preferred embodiment of the present invention, the photodetector array is scanned by the laser scanner and the scanner is modulated to selectively activate photodetectors in the array, and the inkjet nozzles associated with the activated photodetectors apply a pixel image to the media as the media is advanced. This process of laser scanning, ink ejection, and media advancement is continued until the entire image is applied to the media.

Accordingly, a known laser scanning system can be modified for the present invention by substituting as the laser target an array of photodetectors associated with an inkjet printhead. The laser developer and laser toner fixing systems are thereby eliminated in the present invention. Instead, an inkjet printing system is used to apply the image to the media. Thus in an embodiment of the present invention, the scanner is modulated to selectively activate photodetectors of the array, which trigger associated inkjet nozzles. The inkjet nozzles then eject ink droplets that form the image on the media. No undeveloped photoelectric image or otherwise intermediate image is formed. Instead, the scanning system directly scans an image pattern onto the array to trigger the appropriate inkjet nozzles.

Reference is now made again to FIG. 1, which is a schematic of a printer system 101 according to a preferred embodiment of the invention. A laser 113 of the laser scanning system 103 emits a beam of light upon a rotating polygonal mirror 115. The laser 113 is modulated by a control unit 119 and as the mirror 115 rotates the modulated beam 116 is scanned across a row of photodetectors 111 in a photodetector array 109. As the laser 113 is scanned and modulated, the photodetectors 111 are selectively activated by the laser light, or are left unactivated. As the mirror rotates 115, the modulated laser beam 116 impinges upon another facet of mirror, which starts the scan of the beam on the right side in the figure, and scans the beam to the left along a row of photodetectors.

If all of the facets of the mirror are identical, the beam will repeatedly scan the same row of photodetectors, which is suitable for an array with just one-row of photodetectors. To scan an array with two or more rows of photodetectors, adjacent facets on the rotating mirror can be angled differently relative to the axis of rotation of the mirror. Thus, a facet can be angled to scan a row above or below that previously described, as shown the dotted laser beam line in the figure. Accordingly, r rows of a photodetector array can be scanned using a mirror having f facets where $f=r\times n$, where n is an integer. In FIG. 1 modulated laser beam 116*a* represents the laser beam reflected from a mirror facet at a slightly difference angle than that for beam 116, so that beam 116*a* can scan the second row or photodetectors. A third and other subsequent rows of photodetectors can be similarly scanned.

The laser 113 is modulated according to programming of the control unit 117 in order to selectively activate the photodetectors 111. When activated, a photodetector activates an associated inkjet nozzle of the PWA 107 to eject an ink droplet upon the surface of the media, as it moves under the PWA 107. The printhead 105 with PWA 107 is stationary, while the media 106 in transported under the PWA 117 by a suitable transport mechanism 108.

Figure 2:
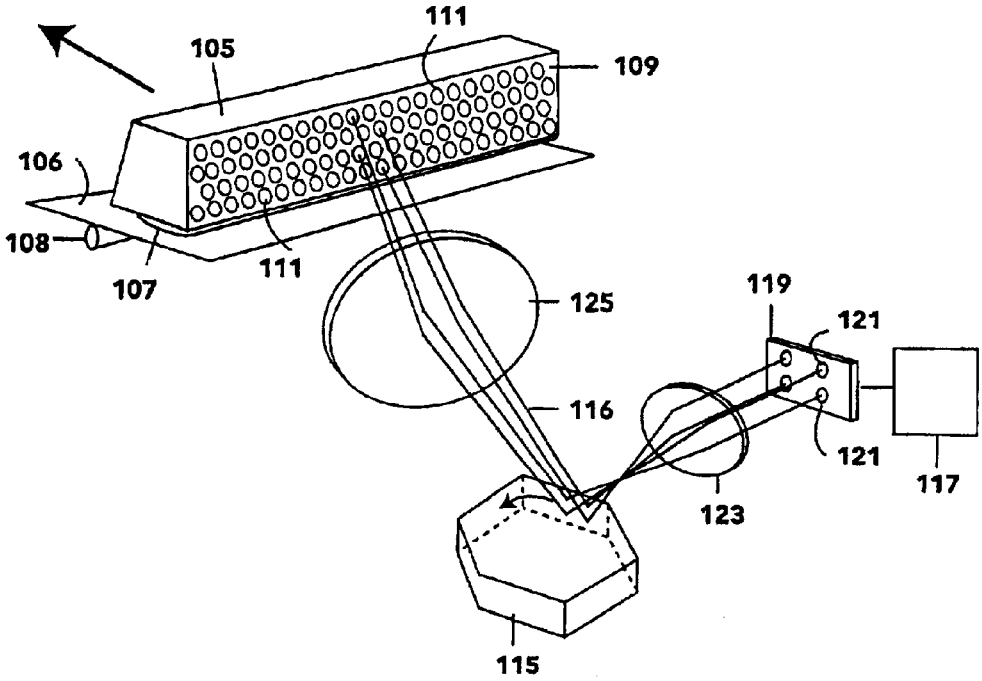
FIG. 2 is a schematic of another printing system of the present invention.

Reference is now made to FIG. 2, which is a schematic of a printer system according to another embodiment of the present invention using an array 119 of multiple lasers 121, which is used to scan more than one row of photodetectors on an array 109. The laser scanning system 103 is essentially as described in U.S. Pat. No. 5,870,132, but applied to the present invention with a PWA inkjet system. In FIG. 2, a semiconductor laser array 119 comprises a plurality of light emitting portions 121 which are disposed two-dimensionally on a device substrate. Modulated laser beams 116 emitted from the light emitting portions 121 are collimated to laser beams with a predetermined beam diameter by a collimator lens 123. The lighting and the amount of light of each of the light emitting portions 121 is controlled by a control unit 117, to modulate the laser beams 116 to activate or leave unactivated a photodetector 111. The laser beams are introduced to one facet of a rotating polygon mirror 115. As the polygon mirror 115 rotates, these laser beams are deflected. The laser beams which pass through an image-forming lens 125 are directed at photodetectors 111 on the photodetector array 109. The scanning systems may also include a tilt angle compensation lens, which is omitted here for simplicity.

As is more fully described in U.S. Pat. No. 5,870,132, the control unit 117 directs the laser beams from light emitting portions 121 to scan along separate raster scan lines. When applied in the present invention, this ability to scan separate scan lines allows the beam from each light-emitting portion 121 to scan a different row from of the photodetector array 109 of the printhead 105.

The laser scanner 103 is modulated according to programming of the control unit 117 to selectively activate the photodetectors. When activated, a photodetector activates an associated inkjet nozzle in the PWA 107 to eject an ink droplet upon the surface of the media, as it moves under the PWA 107. The printhead 105 and PWA 107 is stationary, while the media 106 in transported under the PWA by suitable transport mechanism 108.

Figure 3:
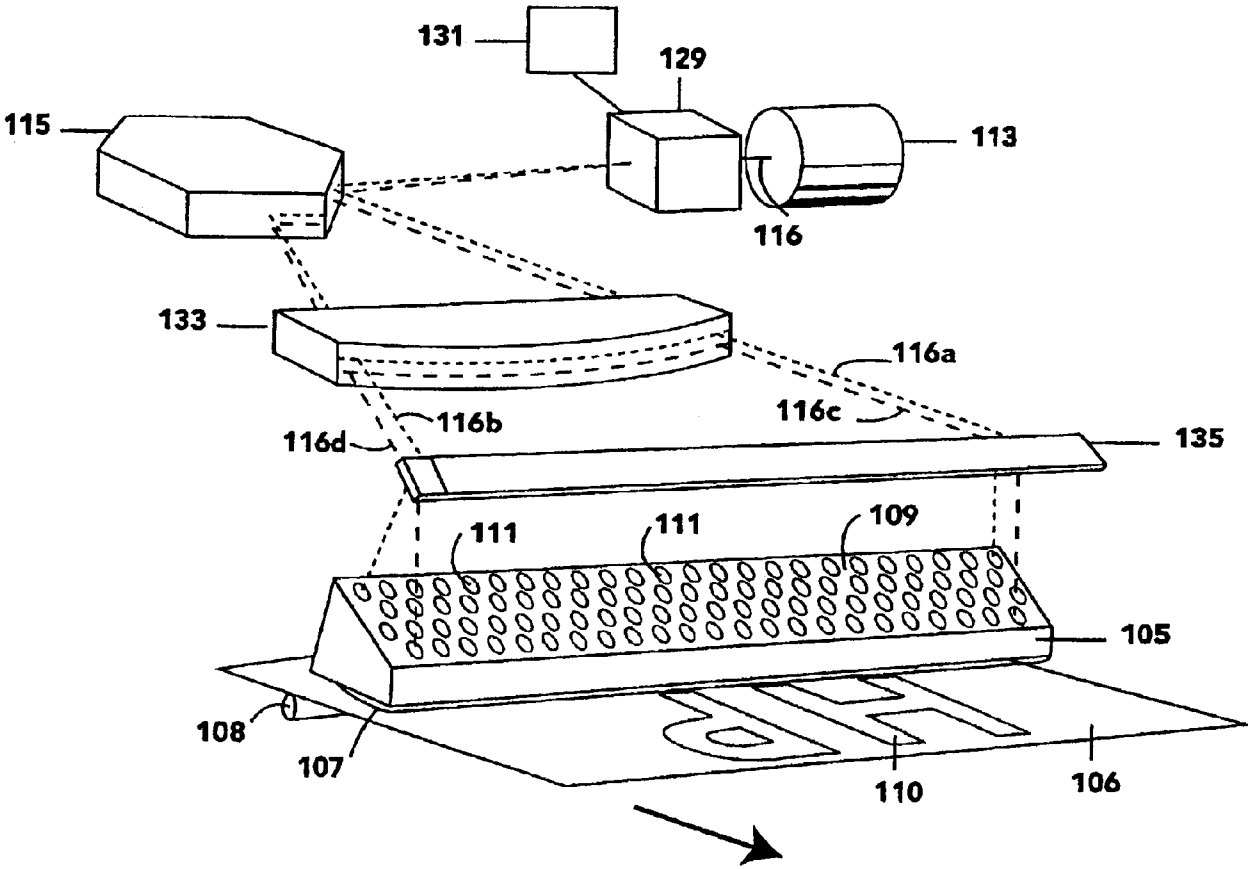
FIG. 3 is a schematic of another printing system of the present invention.

Reference is now made to FIG. 3, which is a schematic of a printer system of the invention 101 using a single laser 113 and two-axis deflector 129. In this aspect of the invention the scanner provides a periodic trajectory scan path for a laser beam across the photodetector array. This laser scanning system is essentially as described in U.S. Pat. No. 5,929,892, but instead of being used to scan a photosensitive surface, the scanner in the present invention scans a photodetector array of a PWA.

Laser 113 directs laser beam 116 through beam deflector 129 which provides beam-deflecting capability. Beam deflector 129 may be a one-axis or a two-axis deflector (as determined in accordance with system design objectives). In the case of a two-axis deflector, an equivalent alternative is two one-axis deflectors (not shown) arranged in the laser beam path such that the resulting deflections are orthogonal, and all references herein to a two-axis beam deflector similarly apply to two orthogonally arranged one-axis deflectors.

Preferably, beam deflector 129 is located between laser 113 and polygon scanning mirror 115 in order to limit the aperture size required in the deflector. Such a beam deflector can in principle be mechanical in nature, operating for example by mechanically translating the laser relative to its collection lens, or by tilting a beam steering mirror. Preferably, however, deflector 129 is an electro-optic (E-O) beam deflector which is well known in the art and provides a suitable combination of frequency response, deflection angle, deflection range, efficiency and flexibility of operation. Deflector 129 is controlled by formatter 131 to maintain amplitude, frequency and phase relationships between deflection of the beam, modulation of laser 113, and rotation of polygon scanner mirror 115.

Rotating polygon scanner mirror 115 scans the beam through lens 133, across folding mirror 135 and across the photodetector array 109 of the printhead 105. Laser beams 116*a* and 116*b* are shown to demonstrate the endpoints of the path of the laser beam as it scans across the photodetector array 109 responsive to rotating polygon mirror 115. Beams 116*c* and 116*d* are shown to demonstrate the multiple beam paths provided by the periodic trajectory. Deflector 129, in cooperation with a rotating polygon scanning mirror 115, provides a periodic trajectory scan path across the photodetector array 109. The periodic trajectory scan in general traces out a curved path which may even be retrograde over some distances. However, by sampling this curved trajectory with appropriately timed laser beam modulation, the printer has access to a grid of photodetectors 111 on the photodetector array. In this example, a rectilinear grid of photodetectors having uniform intervals in the primary grid directions between the photo-detectors, including rectangular grids with uniform spacing in the x (scan) and y (process) directions, are capable of being scanned. The photodetectors in raster rows of the grid may also be staggered, the spacing of photodetectors may vary across the row, and the rows may be nonlinear. This may be suitable if the surface, which supports the laser array, is not flat. The laser may or may not actually be modulated to activate a photodetector at a given grid location. Where the laser is modulated, these are the locations where a photo-detector is activated if it is required for the image being formed. As further described below, no photodetectors are activated at grid locations associated with inkjets over white spaces of an image.

The periodic trajectory scan path provides for a plurality of rows of the array be completed in a single scan pass of the laser beam across photo-detector array to improve printing speed. Printing speed is improved because multiple rows of photodetectors are scanned in one scan pass, thus allowing a wider photodetector array with several rows to be used. This eliminates the need for several passes with a faster rotation of the polygon scanning mirror. As more fully described below in the description of the photo-conductor array, a two-axis deflector system allows a periodic trajectory path to be made that allows several rows of a photodetector array to be covered in only one pass.

The laser scanner 103 is modulated according to programming of the control unit 117 to selectively activate the photodetectors. When activated, a photodetector activates an associated inkjet in a PWA 107 to eject an ink droplet upon the surface of the media, as it moves under the printhead to create an image 110. The PWA 107 is stationary, while the media 106 in transported under the printhead by suitable transport mechanism 108.

Page-Wide-Array Printhead with Photodetector Array

The printhead according to a preferred embodiment of the present invention comprises a PWA printer element with an array of photodetectors. The printer head also comprises a flexible circuit to provide electrical connection between photodetectors of the array to the firing resistors of the PWA.

Figure 4:
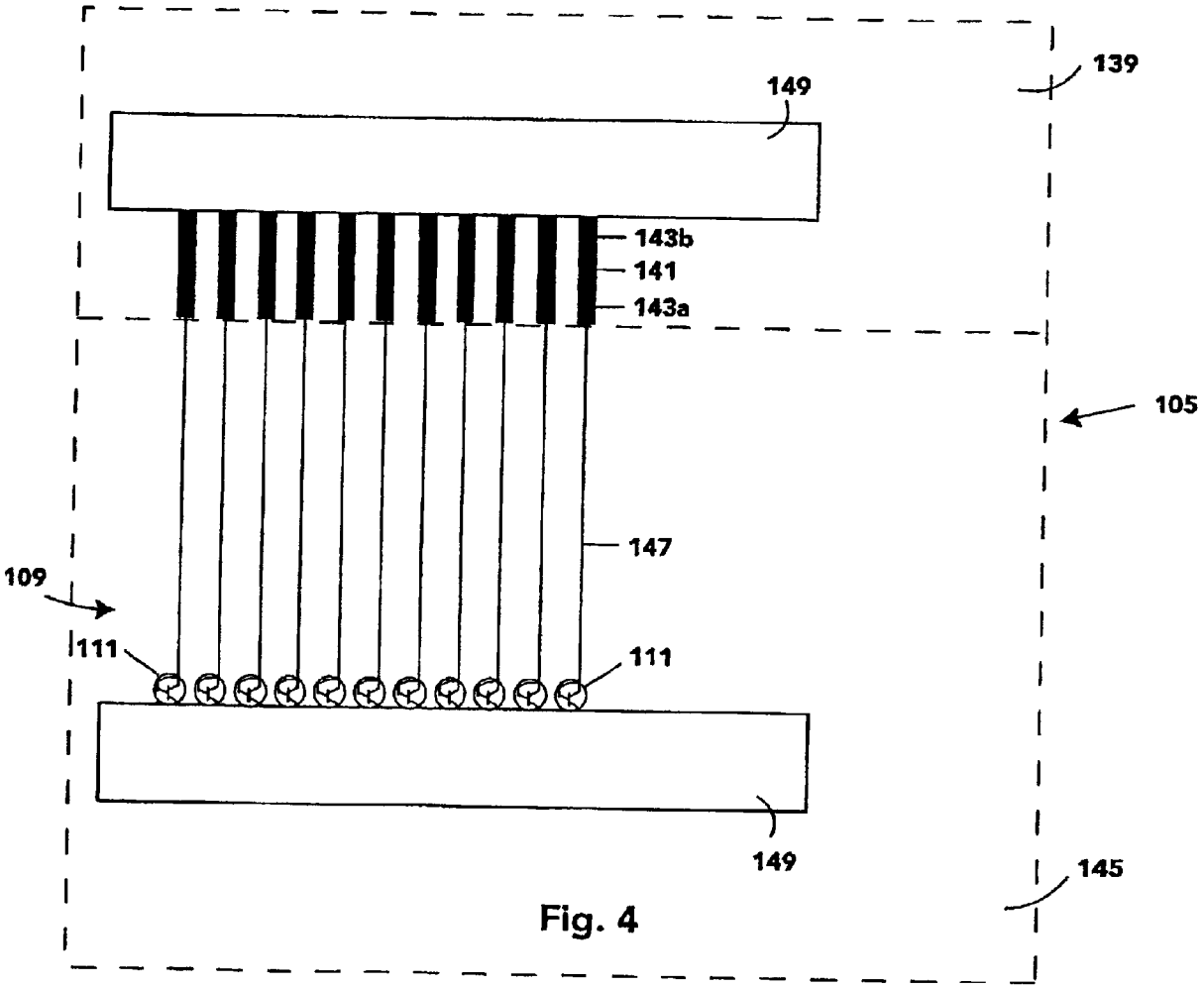
FIG. 4 is a schematic of a printhead according to an embodiment of the present invention.

Reference is now made to FIG. 4, which is a schematic showing a printhead 105 according to an embodiment of the present invention. A printhead 105 invention comprises PWA printbar 107 which in constructed with an array of inkjets on a substrate 139. In the figure only the firing resistors 141 along with the interconnect lands 143*a,* 143*b* of the inkjets are shown for simplicity.

An array 109 of photodetectors 111, wherein one photodetector is associated with each firing resistor 141. In the figure, the illustrated photodetectors 111 are photodarlington transistors. Connecting the photodetectors with the firing resistors is a flex circuit 145 with conducting strips 147 which parallel connect each firing resistor 141 with a photodetector 111 through one of its interconnect lands 143*a*. To provide a circuit, power supply rails 149 with a potential difference between them are provided, one connected to the firing resistors through another interconnect land 143*b,* and one to the photodetectors 111, as illustrated.

The photo-darlington photodetectors 111 provide an open circuit when no light is shining upon the detector. When light is shined on the detector, the circuit is closed, and current flows through the associated firing resistor, which activates the inkjet to eject an ink droplet. The photodetectors can be mounted on the flex circuit using any suitable system for mounting such electrical components on a device substrate, where the device substrate is the flex circuit.

Other photodetector systems can are contemplated by the invention. For example multiple inkjet nozzles could be selectively activated at the same time by laser light from the scanner shining on an associated photodetector, such as by using different combinations of electrical connections or other communication links between the inkjet nozzle(s) and the photodetector. Suitable photodetectors include, for example, any of various chip-device photodetectors, such as photodiodes, phototransistors, photo-FETs, or photodarlingtons.

The Printer Element

The printer element shown as a PWA 107 in FIG. 1 can be constructed according to known PWA technology. The printer element is then connected by any suitable system to a photodetector array, which may or may not require modification of the printer element. PWA print systems are disclosed in, for example, U.S. Pat. Nos. 5,719,602; 5,734,394; 5,742,305; and 6,135,586, which are hereby incorporated by reference.

Figure 5:
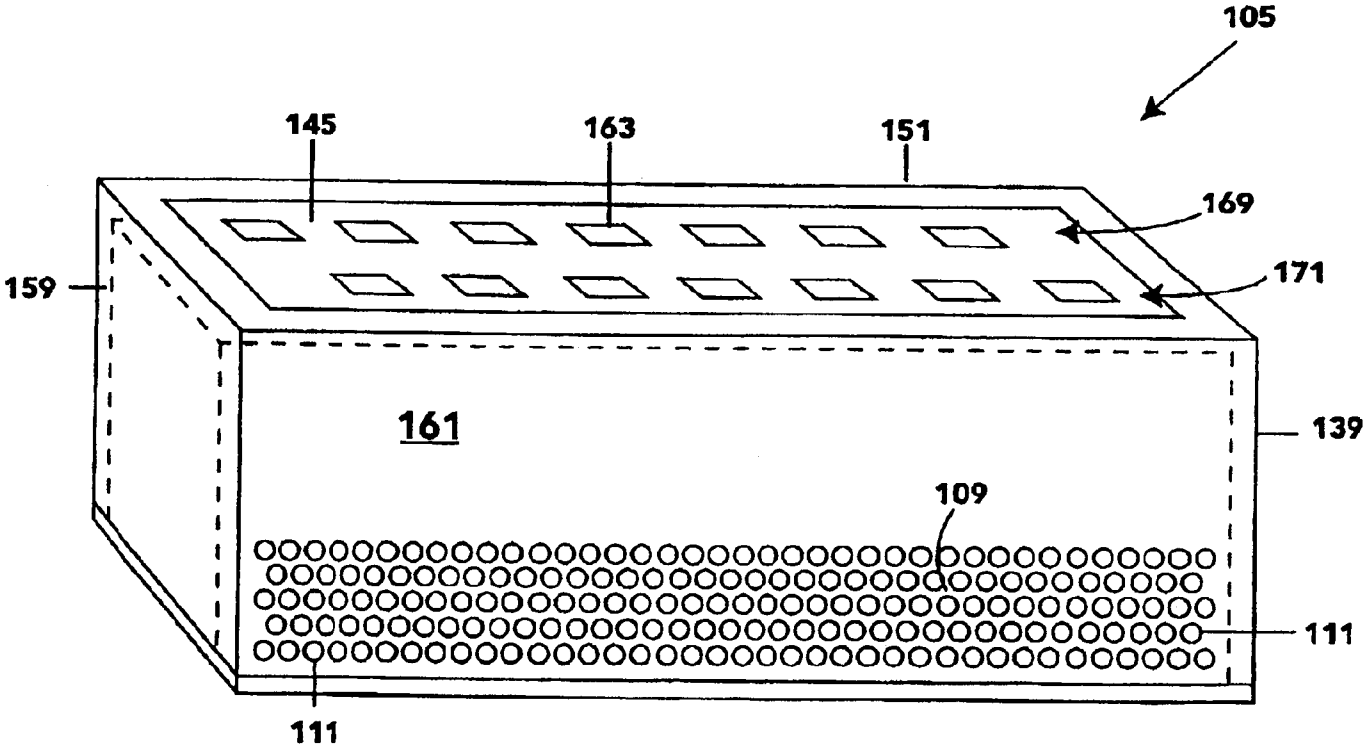
FIG. 5 is another schematic of a printhead according to an embodiment of the present invention.
Figure 6:
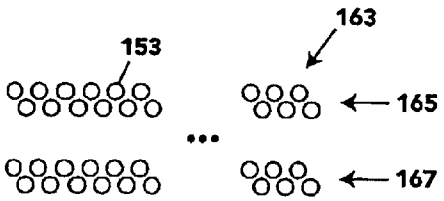
FIG. 6 is a schematic showing a nozzle array in a printbar according to an embodiment of the present invention.
Figure 7:
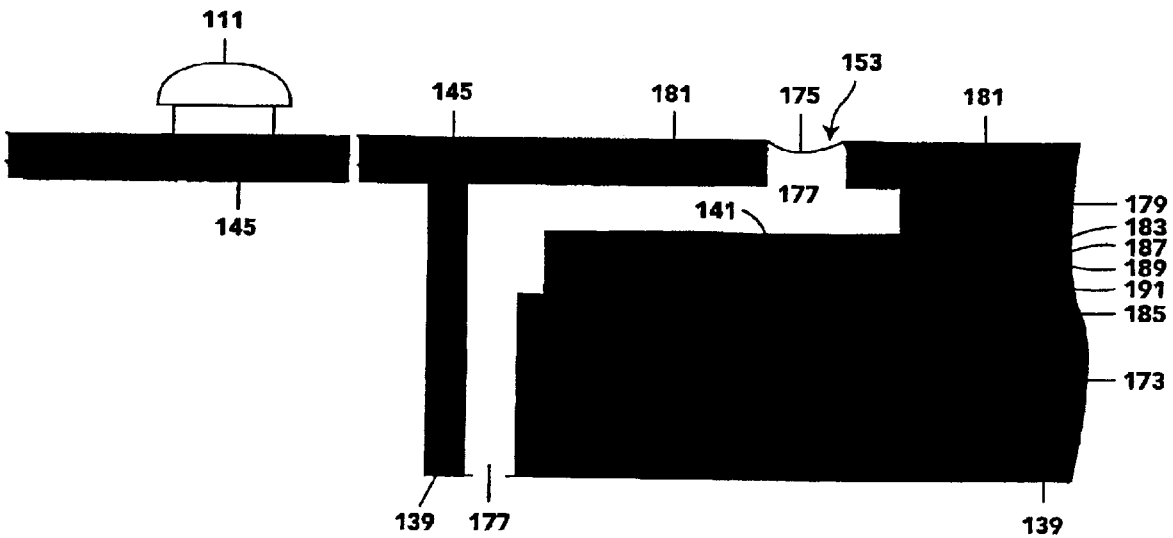
FIG. 7 is a schematic cross-section showing a printhead with photodetectors and inkjets.

Reference is now made to FIGS. 5, 6, and 7. FIG. 5 shows a printhead 105 with an inkjet page-wide-array ("PWA") printer element. The printer element extends at least a page-width in length (e.g., 8.5", 11" or A4) and ejects liquid ink droplets from nozzle groups 163 onto a media sheet. When installed in a printer in accordance with an embodiment of the present invention, the printer element is preferably fixed. The media sheet is fed adjacent to a printhead surface 151 of the printer element during printing. As the media sheet moves relative to the PWA printhead 105, ink droplets are ejected from inkjet nozzles 153 (see FIGS. 6 and 7) to form pixel patterns or other markings representing characters or images. The PWA printhead 105 prints one or more lines of dots at a time across the page-width. The printhead 105 may include thousands of nozzles 153 across its length, but only selected dots are activated at a given time to achieve the desired markings. A solid line along a row for example, would be printed using all nozzles located between the endpoints of such a line. In one embodiment an 11 inch printhead with 600 dpi resolution has at least 6600 nozzles. More nozzles may be present if more sets of nozzles are present to print more that one row at a time. One set of nozzles is preferred where it is desired to decrease complexity and increase the data transfer speed. More than one set of nozzles for a monochrome printer would be preferred to achieve a higher print speed, an interlaced printing pattern or achieve more refill time for the ink nozzles. However, this is at the cost of more complexity and a slower data transfer.

In one embodiment the printer element 107 includes a printbar body 139, a flexible printed circuit ("flex circuit") 145, and nozzle circuitry. The printhead 105 is formed by a first or printhead surface 151, the nozzle circuitry and the flex circuit 145. The printbar 139 serves as the body for the printer element 107 to which other components are attached. In one aspect of the invention the printbar 139 is approximately 12.5" by 1" by 2.5" and a first surface 151 is defined to be approximately 12.5" by 1". The body 139 also defines an internal chamber 159 for holding an ink supply. In some embodiments the chamber 159 serves as a resident reservoir. The chamber may be the sole ink supply or connected to an external ink source located within the printer but separate from the printbar body 139.

Attached to the printbar 139 at the first surface 151 is the flex circuit 145. The flex circuit 145 is a printed circuit made of a flexible base material having multiple conductive strips 147 (See FIG. 4). The flex circuit 145 extends over second surface 161 and with the conductive paths 147 running from each photo-detector 111 on the photo-detector 109 array to a corresponding nozzle 153. The nozzles may be arranged in any suitable configuration. As illustrated in the figures, the nozzles are in the nozzle groups 163. In one aspect of the invention, the flex circuit 145 is formed from a base material made of polyamide or other flexible polymer material (e.g., polyester, poly-methyl-methacrylate) and conductive paths made of copper, gold or other conductive material. The flex circuit 145 with only the base material and conductive paths is available from the 3M Company of Minneapolis, Minn. The nozzle groups 163 and photo-conductor array 109 are then added.

FIG. 6 is a diagram of a nozzle group 163. The nozzle groups can be constructed as a substrate structure according to conventional practice. Substrate structures for printing across a wide swath as the media passes under the structure are contemplated. Such structures are disclosed in U.S. Pat. No. 5,984,464, which is hereby incorporated by reference. In the illustrated embodiment or FIGS. 5 and 6, each nozzle group 163 includes two rows 165, 167 of printhead nozzles 153. Flex circuit conductors meet with nozzle group conductors to define a circuit path. In one embodiment for an 11-inch printhead with 600 dpi resolution, there are 32 nozzle groups 163, and sixteen groups per row of nozzle groups 169,171. Each group extends approximately 0.5 inches and is offset from adjacent groups 163 in the other row. Each nozzle group includes two rows 165, 167 of printhead nozzles 153. Each row includes at least 150 printhead nozzles 153. The nozzles 153 in a given row 165 or 167 are staggered or precisely aligned. Further the nozzles 153 in all rows 169 or 171 of nozzle groups 163 are staggered or precisely aligned. In FIGS. 5–6, illustrated are four lines of nozzles 153 in the nozzle groups 163 in rows 169, 171 which comprise a PWA nozzle array used for printing one line of approximately 6600 dots.

Referring in particular to FIG. 7, in one aspect of the present invention, a silicon substrate 173 defines nozzle circuitry. Other circuit elements may also be added if appropriate. When light shines upon a photodetector 111, the photodetector is activated and sends a firing signal which caused the circuit to excite a resistor 141, which in turn heats up ink 175 within a nozzle chamber 177. Some of the ink vaporizes, and some of the ink is displaced so as to be ejected as a droplet having a known repeatable volume and shape.

In FIG. 7 a printhead nozzle 153 is loaded with ink 175. In one aspect of the invention, a silicon substrate 173 with additional layers defines one or more nozzles 153 in the nozzle group attached to the printbar 139 and flex circuit 145. A nozzle 153 receives ink 175 from a printbar reservoir via a channel 177. The ink flows into a nozzle chamber 177. The nozzle chamber 177 is defined by a barrier film 179, a nozzle plate 181 and a passivation layer 183. Additional layers are formed between the substrate 173 and passivation layer 183, including insulative layers 185, 187, another passivation layer 189 and a conductive film layer 191. The conductive film layer 191 defines a firing resistor 141.

In one embodiment the nozzle plate 181 is mounted to the flex circuit 145 with the nozzle circuitry. In another embodiment the flex circuit forms the nozzle plate 181. According to the flex circuit embodiment for the nozzle plate 181, respective orifices are laser drilled to achieve a precise area, orientation and position relative to the nozzle chambers 177. The nozzle orifice has a uniform diameter for each nozzle. In various aspects the nozzle orifice can range between 10 and 50 microns in diameter.

The substrate 173 typically defines nozzle circuitry for several nozzles. In one embodiment a substrate defines nozzle circuitry for a given nozzle group 163. In another embodiment a substrate defines the same for multiple nozzle groups 163.

The photodetector 111 is mounted in the flex circuit 145 by suitable systems for mounting a device on a flex circuit substrate. As illustrated in FIG. 4, the flex circuit has conducting strips between the resistor 141 and the photodetector 111.

Figure 8:
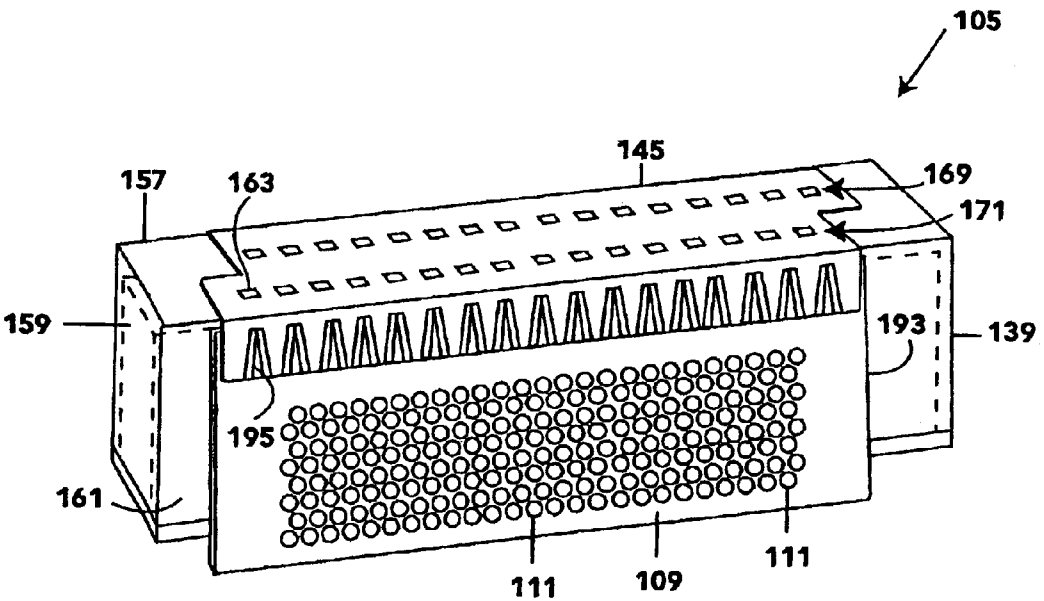
FIG. 8 is a schematic showing an alternate printhead according to an embodiment of the present invention.

Reference is now made to FIG. 8, which shows an alternative aspect of the invention. The photodetector array 109 is located on one or more separate printed circuit boards 193 attached to the printbar 139. The print head 105 includes the printbar 139, flexible printed circuit (flex circuit) 145, nozzle groups 163 with nozzles and nozzle circuitry, and photodetector array circuit boards ("photo-pcb") 193. The attachment of the circuit board can be constructed, for example, by adapting the printbar disclosed in U.S. Pat. No. 5,742,305 that has attached memory boards.

The printhead 105 comprises a printbar 139 with the first surface 157, having nozzle circuitry and the flex circuit 145. A photo-pcb 193 is attached at a second surface 161. In one embodiment the photo-pcb 193 is permanently attached using an adhesive, bonding, soldering, welding or other attachment process. In addition to being attached to the printbar 139, the photo-pcb 193 also is attached to the flex circuit 145. In one embodiment photo-pcb contacts are in physical and electrical communication with respective peripheral contact groups 195 of the flex circuit 145. The photo-pcb 193 comprises one or more photoconductor arrays 109 with photodetectors 111. Conductive paths extend from the photodetectors 111 to photo-pcb contacts. Thus signal paths are defined from the photodetectors 111 along the flex circuit 145 and to printhead nozzles 153.

The Photodetector Array

Figure 9:
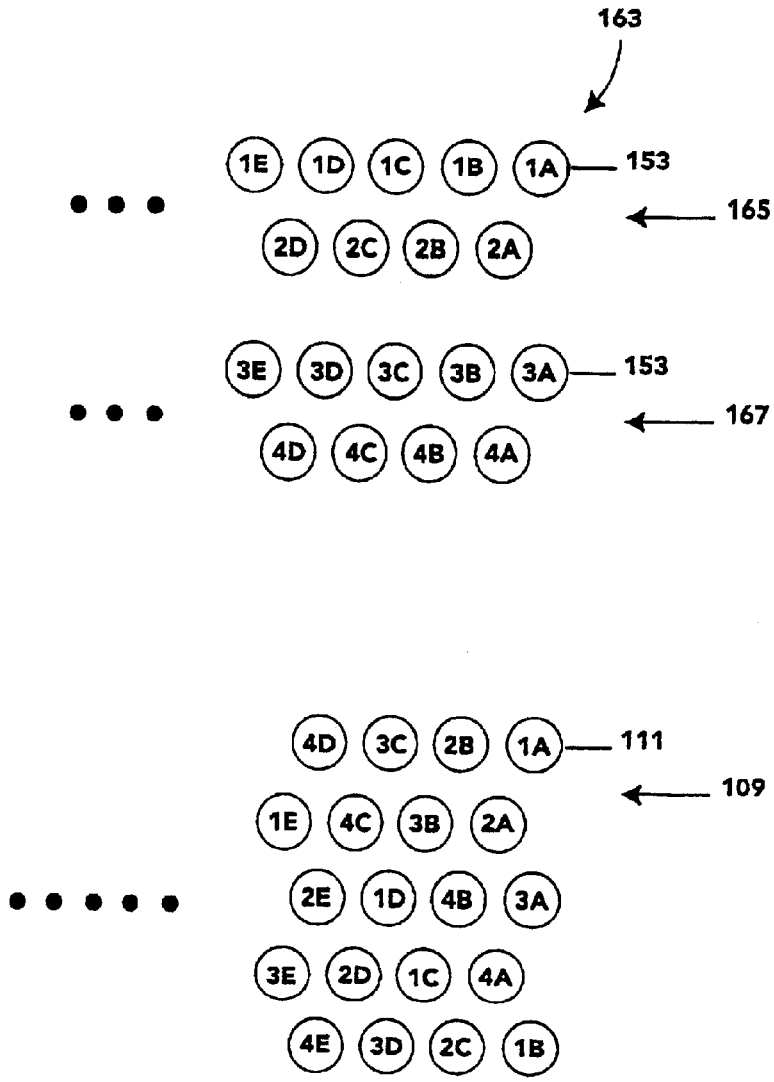
FIG. 9 is a schematic showing mapping of photodetectors in a photodetector array to inkjet nozzles on a printbar.

Reference is now made to FIG. 9, which shows schematics of a nozzle group 163 and a photodetector array 109. Each photodetector 111 in the array corresponds to an inkjet nozzle 111 in the print head. Accordingly, the programming of the laser scanner, the arrangement of the photodetectors, the movement of the media, and other factors are coordinated so that each inkjet nozzle is activated at the appropriate moment to image the media. In one aspect of the invention, the printhead nozzles are disposed in a one-row array with nozzles extending along a single axis the length of the PWA, and the photodetectors are like-wise in a one-row array. In this arrangement, all of the inkjets required to image a single raster scan of dots on the media are activated in a single scan of the scanner. In such an instance, the laser scanner is programmed similarly as it would for an electrophotographic imaging system, for the data used to write on the photosensitive surface is the same as that used to scan the photodetector array and activate the inkjets. Likewise, if the nozzles of the PWA are in a rectilinear array and the photodetectors in a corresponding array, the data can be the same as the same as for an electrophotographic system.

However, PWA printheads are often constructed with nozzle plates in subunits, with the nozzles in groups and subgroups on separate substrates as described above. A PWA printhead with a full rectilinear nozzle array on a single substrate may be difficult to construct. Accordingly, the relative positions of the photo-detectors in the photo-detector array may not correspond to the positions of the nozzles in the PWA. Accordingly, the programming of the laser scanner is modified to compensate for these differences. Factors that are considered in the programming are the arrangement of the photo-detectors in the photo-detector array and the timing of firing for each nozzle, considering issues regarding firing sequencing and timing, movement of the media, the scanning rate of the laser, and other issues that are known in the art. The programming may also include media image and motion sensors incorporated appropriate feed back systems. Basically, the goal is to program the laser scanner to scan the array and fire the right nozzle at the right time. Appropriate programming of the scanner is well within the ability of one of ordinary skill in the art.

Since the programming can be modified at will, the photodetector array need not resemble the relative positions of the nozzles. Accordingly, the photodetector array can be constructed to increase the efficiency of the scanning by considering nozzle sequencing and timing, and to simplify the construction of the electrical path between each photodetectors and its associated inkjet nozzle. One approach would be to focus mainly on simplifying and shortening the electrical paths. In such an instance, illustrated in FIG. 9, the nozzle assignment of the photodetectors 111 in the array 109 may seem random upon first examination. In FIG. 9, is shown an exemplary assignment scheme (labeled as 1A, 1B, . . . , 2A, 2B,) showing part of a nozzle array or group 163 with nozzles 153 disposed as in FIG. 6 in rows 165, 167 mapped to photodetector array 109 with five rows of photodetectors 111.

Figure 10A:
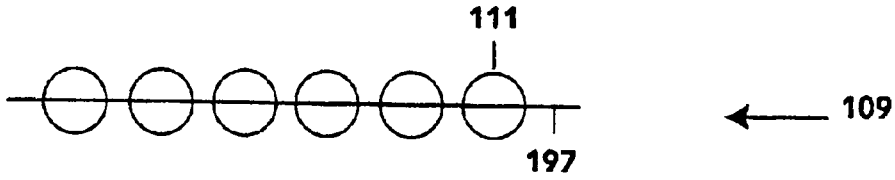
FIGS. 10A, 10B, 10C, and 10D are schematics illustrating scanning paths of the laser scanner for scanning photodetectors of a photodetector array.
Figure 10B:
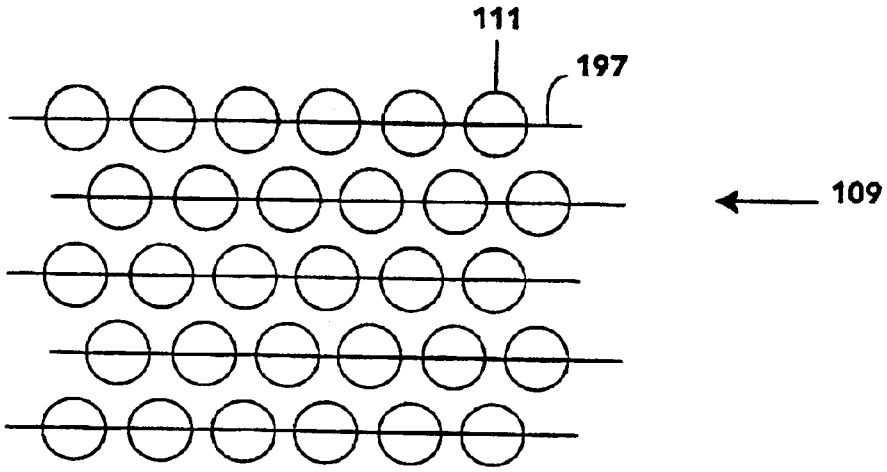
Figure 10C:
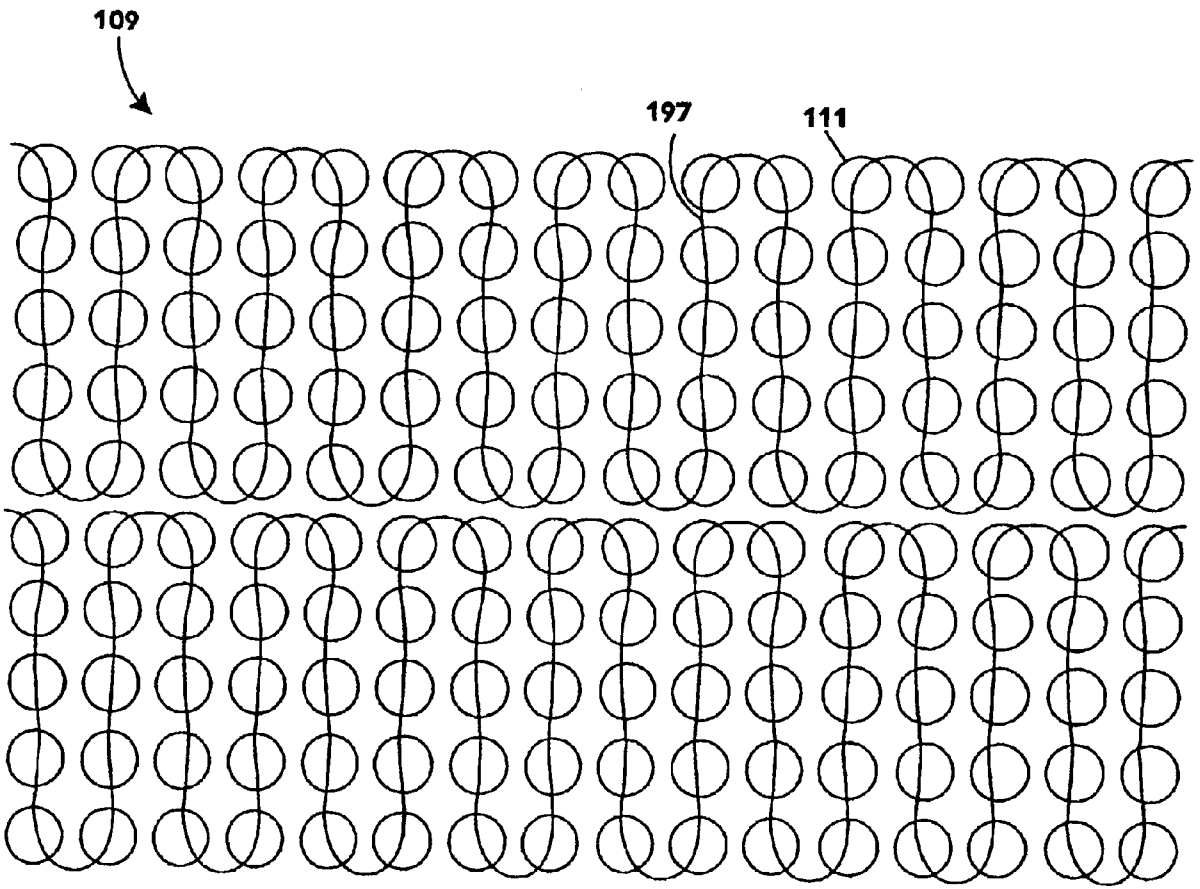
Figure 10D:
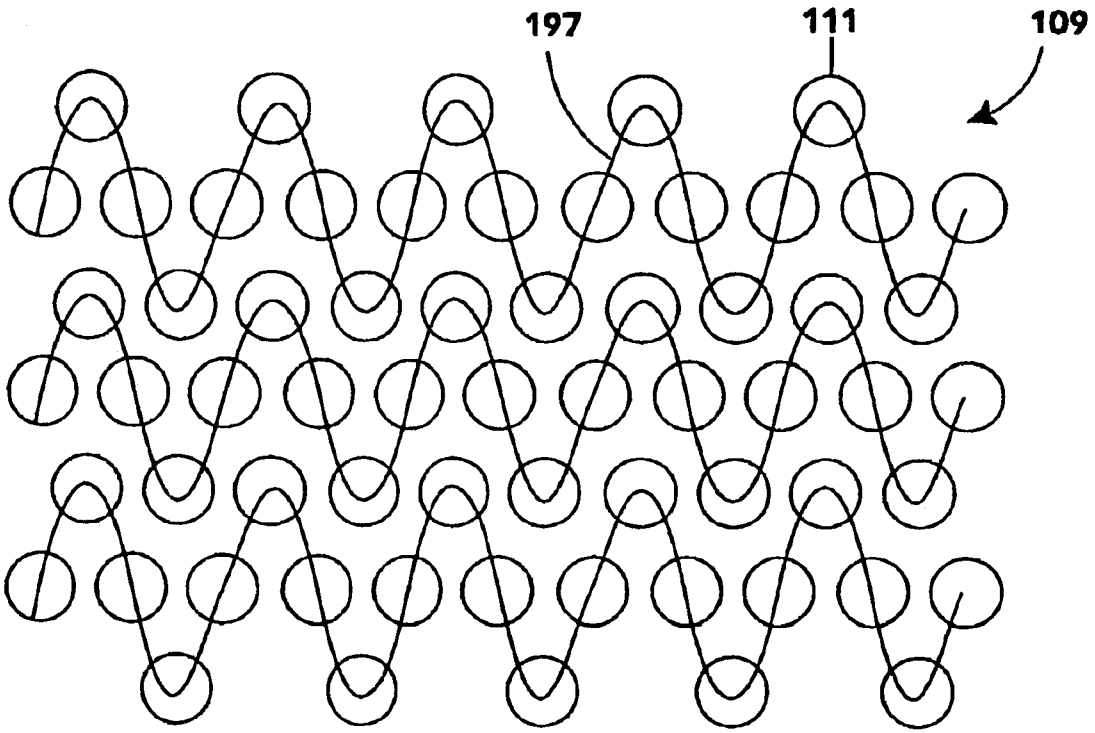

Reference is now made to FIGS. 10A, 10B, 10C and 10D which show aspects of photodetector arrays according to embodiments of the present invention and the scanning pattern of the laser scanner. The construction of the photodetector array in any suitable arrangement of photodetectors adaptable to scanning by the laser scanner. FIG. 10A shows a linear photodetector array that can be scanned by a laser scanner as illustrated in FIG. 1, showing a straight scanning path 197. Multi-row photoconductor arrays can be scanned by laser scanning systems as illustrated in FIGS. 1, 2 or 3. FIG. 10B shows a multi-row photodetector array showing straight scanning paths for each row, using a laser scanner as in FIG. 1 using a mirror with varied facets, or a multibeam laser scanner as in FIG. 2. FIG. 10C shows a 10-row array scanned five rows at a time with a multiple frequency omega-wave scanning path 197 that is obtained from a laser scanner with a two-axis deflector as in FIG. 3. FIG. 10D shows a non-rectilinear photodetector array 109 that can be scanned another aspect of a two-axis scanner as in FIG. 3, using a triangle wave scanning path 197. Suitable two-axis scanning systems are disclosed in U.S. Pat. No. 5,929,892. Any suitable trajectory method and modulation programming of the laser is contemplated by the present invention.

In general the design of a scanner and photodetector array; the size of the light detection aperture of the photodetector, the spacing of the photodetectors on the array, and the transit time of the scanning laser beam across the array are adjusted to activate an inkjet resistor, which typically is about 4–5 $\mu$sec. The photodetectors can be larger than a target pixel activated by a laser scanner on a photosensitive drum in a laser printer. The photodetectors may be mounted in a rectilinear fashion on the array. However, because of the larger size, arrays of photodetectors configured to reduce the size of the array are contemplated, such as a staggered arrangement. The surface of photodetector array upon which the photodetectors are mounted can be flat, or to achieve any operational, spacing or manufacturing advantage, the array can be of any suitable shape or configuration, and be mounted on a curved or flat surface.

Figure 11:
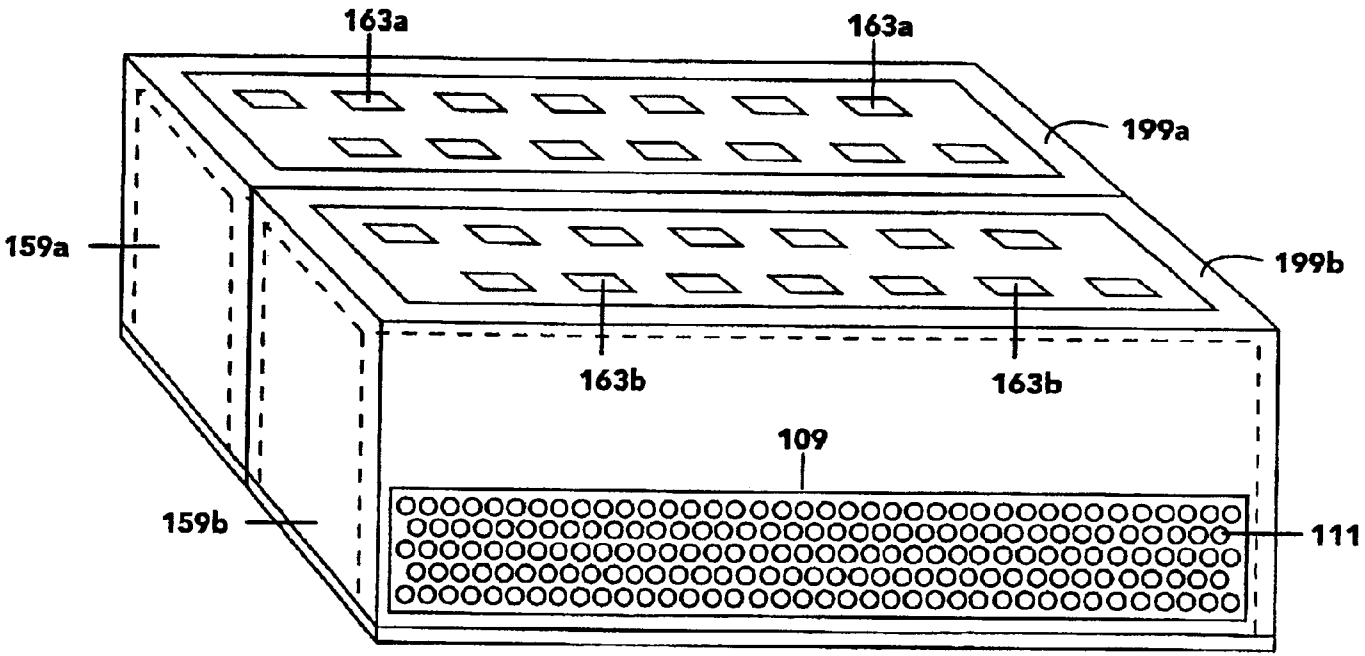
FIG. 11 is a schematic of a multicolor printhead according to an embodiment of the present invention.

The present system is adaptable to both monochrome and color inkjet systems. With reference to FIG. 11, to adapt a PWA printhead for color, nozzle groups can be grouped into separate color groups with each color group having a separate chamber for ink. For a first color an ink chamber 159*a* supplies nozzle groups 163*a* in first color group 199*a*. For the second color group 199*b*, second ink chamber 159*b* supplies second nozzle groups 163*b*. Only two groups for two colors are shown in the figure for simplicity, but most embodiments would have either 3 or 4 colors. In general, known multichambered designs for inkjet heads can be adapted by expanding the multichambered designs to a PWA dimension. Suitable multichambered designs that may be adapted for the present invention are disclosed in U.S. Pat. No. 4,812,859, which is hereby incorporated by reference. The photodetectors 111 in the photodetector array may be mapped to the nozzles in the nozzle groups 163*a*, 163*b* in any suitable way. Alternately, a separate print engine with scanner and PWA with photodetector array may be used for each color. Multichambered and multi-print-engine designs may also be used in a monochrome system to, for example, increase resolution or print speed.

While this invention has been described with reference to certain specific embodiments and examples, it will be recognized by those skilled in the art that many variations are possible without departing from the scope of this invention, and that the invention, as described by the claims, is intended to cover all changes and modifications of the invention which do not depart from the scope of the invention.

We claim as our invention:

1. A printhead for applying markings on media, comprising:

one or more print elements which can be selectively activated to apply markings on media;

a photosensitive detector coupled to said one or more print elements via a flex circuit to control activation of said print elements during a printing operation thereby causing a predetermined pattern of markings to be applied by said print elements to the media.

2. The printhead of claim 1 wherein said one or more print elements include a plurality of inkjet nozzles.

3. The printhead of claim 1 wherein said one or more print elements include a plurality of thermal inkjet nozzles which are coupled to said photosensitive detector through electrical conductors on the flex circuit.

4. The printhead of claim 1 which further includes a chamber for holding ink to be supplied to said one or more print elements.

5. The printhead of claim 1 wherein said photosensitive detector includes a plurality of separate photodetectors arranged in an array, with each separate photodetector electrically coupled to an individual one of said one or more print elements, respectively.

6. An imaging apparatus comprising:

a printhead having at least one print element;

a photosensitive member electrically coupled to said at least one print element; and an optical scanner for directing light toward the photosensitive member to selectively activate said at least one print element during a printing operation, wherein the optical scanner includes a two-axis deflector for generating a periodic two-dimensional scan path of the light.

7. The imaging apparatus of claim 6 wherein said printhead includes a plurality of inkjet nozzles on a print bar positioned over media, and where said photosensitive member includes a plurality of separate photodetectors which are respectively coupled to said plurality of inkjet nozzles via a flex circuit to selectively activate said plurality of inkjet nozzles.

8. The imaging apparatus of claim 7 wherein said print bar includes one or more rows of nozzles extending across the media.

9. The imaging apparatus of claim 7 wherein said plurality of separate photodetectors are arranged in a linear array on said printhead.

10. A printing system for applying markings to media comprising:

advance means for transporting media through a print zone;

a print bar having a plurality of ink firing elements extending across the print zone;

photosensitive means operatively coupled to said print bar with a flex circuit for selectively activating certain of said ink firing elements; and optical scanning means for directing light toward said photosensitive means in accordance with a pattern of dots to be applied to the media by said ink firing elements.

11. The printing system of claim 10 wherein the print bar includes a page width array of ink firing elements.

12. The printing system of claim 11 wherein the print bar is mounted to be stationary over the media while the ink firing elements apply the pattern of dots to the media, and wherein the advance means periodically advances the media to a new printing position.

13. The printing system of claim 10 wherein said ink firing elements are inkjet nozzles, and wherein said optical scanning means is a laser scanning device.

14. The printing system of claim 10 wherein said photosensitive means includes an array of photodetectors each electrically coupled to an associated ink firing element on the print bar.

15. The printing system of claim 10 wherein said ink firing elements are thermal inkjet nozzles, and further including electrical conductors connected between said ink firing elements and said photosensitive means.

16. A method for printing an image on media comprising:

positioning media in a print zone;

providing a plurality of ink ejectors with respect to the media such that an image is formed on the media when an ink ejector is selectively activated;

coupling a plurality of photodetectors respectively to the plurality of ink ejectors such that the ink ejector is activated upon light activation of the photodetector; and directing a modulated laser beam to scan across the photodetectors in a periodic two-dimensional scan path to cause a pattern of ink dots to be applied to the media from the ink ejectors.

17. The method of claim 16 which includes mounting the plurality of ink ejectors on a print bar, and holding the print bar in a stationary position while the pattern of ink dots is applied to the media from the ink ejectors.

18. The method of claim 16 which includes locating the photodetectors in an array constituting a plurality of rows to facilitate scanning across the photodetectors.

19. The method of claim 16 which includes locating the plurality of ink ejectors in a page width array across the media, and printing an entire row of dots on the media while the media and the ink ejectors are both in stationary position.

20. The method of claim 16 which includes providing separate sets of ink ejectors in an array across the media, and supplying different types of ink to respective sets of ink ejectors.

21. A method of printing comprising:

periodically advancing media through a print zone;

holding the media in a stationary position during a printing operation;

mounting a plurality of printing elements on a print bar over the print zone;

connecting individual print elements through a flex circuit to a photosensitive member having an array of photodetectors;

scanning a laser beam across the array of photodetectors to sequentially target individual photodetectors in accordance with a pattern of dots to be printed on the media, thereby causing selective print elements to be activated during a printing operation.

22. The method of claim 21 which includes mounting the print elements in multiple rows on the print bar.

23. The method of claim 21 which includes locating the individual photodetectors in an array of multiple rows.

24. The method of claim 21 which includes mounting a plurality of printing elements on the print bar in a page width array over the print zone.

* * * * *